US010961033B2

(12) United States Patent
Khouri

(10) Patent No.: US 10,961,033 B2
(45) Date of Patent: Mar. 30, 2021

(54) BLISTER PACK SYSTEM

(71) Applicant: John Ibrahim Khouri, Orland Park, IL (US)

(72) Inventor: John Ibrahim Khouri, Orland Park, IL (US)

( * ) Notice: Subject to any disclaimer, the term of this patent is extended or adjusted under 35 U.S.C. 154(b) by 125 days.

(21) Appl. No.: 16/379,909

(22) Filed: Apr. 10, 2019

(65) Prior Publication Data

US 2019/0329952 A1 Oct. 31, 2019

Related U.S. Application Data

(60) Provisional application No. 62/663,296, filed on Apr. 27, 2018.

(51) Int. Cl.
*B65D 75/36* (2006.01)
*A61J 1/03* (2006.01)

(52) U.S. Cl.
CPC ..... *B65D 75/367* (2013.01); *A61J 1/035* (2013.01); *B65D 2575/3227* (2013.01)

(58) Field of Classification Search
CPC ..... B65D 75/367; B65D 75/327; B65D 2575/3227; B65D 75/36; A61J 1/035
USPC ..... 206/461, 531, 528, 538
See application file for complete search history.

(56) References Cited

U.S. PATENT DOCUMENTS

| | | | | |
|---|---|---|---|---|
| 3,689,458 | A * | 9/1972 | Hellstrom | B65D 75/328 206/530 |
| 3,780,856 | A * | 12/1973 | Braverman | B65D 75/327 206/534 |
| 3,921,805 | A | 11/1975 | Compere | |
| 7,926,660 | B2 | 4/2011 | Jones et al. | |
| 8,479,921 | B2 | 7/2013 | Ingraham | |
| 8,931,383 | B1 | 1/2015 | Hurwicz | |
| 2011/0308992 | A1* | 12/2011 | Bahcall | B65D 75/566 206/581 |
| 2014/0203017 | A1* | 7/2014 | Fowler | B65D 21/0204 220/23.83 |
| 2016/0302552 | A1 | 10/2016 | Oh et al. | |
| 2017/0274273 | A1* | 9/2017 | Murase | B65D 65/10 |
| 2018/0027945 | A1* | 2/2018 | Oh | A61K 8/9706 |

* cited by examiner

*Primary Examiner* — Steven A. Reynolds
(74) *Attorney, Agent, or Firm* — Aronberg Goldgehn Davis and Garmisa

(57) ABSTRACT

The technology described herein generally relates to a blister pack system. The blister pack system includes multiple cavities for storing products. For example, four cavities may hold four different products. A technician may extract the four different products in a particular order. The blister pack makes it easy for the technician to determine which product to use first, and to determine which successive product to use even if the orientation of the blister pack is changed during the process.

20 Claims, 4 Drawing Sheets

BLISTER PACK SYSTEM

INCORPORATION BY REFERENCE

This application claims priority to and incorporates by reference in its entirety and for all purposes U.S. Provisional Patent Application Ser. No. 62/663,296 filed on behalf of John Ibrahim Khouri.

BACKGROUND

The present blister pack system is directed to a single package that may house a variety of different substances for systematic application.

Technicians working with hand and foot care and providing manicures and pedicures generally utilize a number of products to assist in the nail care process. They may create a soaking solution to soften the skin and nails. They may apply a scrubbing compound to help clean the nails and skin. They may apply a scrub, such as a sugar scrub to exfoliate or clean the customer. They may then apply a mask. They may then apply a lotion.

Previously, these products were supplied separately. For example, a salon would purchase a large container of concentrate for creating the soaking solution. Large quantities of the scrub, mask, and lotion compounds could also be purchased. In each case, the technician would need to measure out the amount needed for each individual customer. This would result in inefficiencies such as lost time in how long it would take to get out each of the large containers and use a measuring device to portion the products out. The products would need to be deposited into receptacles for use during the manicure or pedicure process. Manipulating multiple containers during a procedure would also lead to cross contamination or require the technician to switch out gloves repeatedly which was inconvenient and wasteful.

Different technicians would often use more product than was necessary leading to waste. The use of receptacles for products would also increase costs because the salon would need to purchase disposable receptacles or clean the receptacles.

One attempt at a solution was to prepare individual containers of the products. With that system, a technician would collect, for example, four separate pouches, each with a different product inside. The technician would then open each pouch in preparation for use. However, while that helped with portion control, the problem of requiring additional receptacles remained. Also, the pouches required a significant amount of material to form the overall pouch leading to a large increase in expense over the bulk containers. The pouches also required that the technician be able to read what the contents of the pouches were which was often a problem for foreign technicians. Thus, there is a need for a simple solution that manages the products, eliminates waste, is easy to use, eliminates the need for additional receptacles, and does not require the ability to read.

SUMMARY

The present blister pack system generally comprises an at least four cavity blister pack that can contain a variety of different substances. The substances may be used by a technician in the manicure or pedicure process.

Each cavity of the blister pack system is specially adapted for the substance it contains. One cavity is specially adapted for a solid tablet. The tablet may be used to create the soaking solution. The other three cavities may essentially be of bowl or "U" shapes. The three cavities are filled with a viscous fluid, such as a cream, paste, or gel, that may be scooped out by the technician. The curvature of the sides of the cavities facilitates the removal of the fluid. The cavities may be large enough to accommodate an adult human finger. The size and shape allow the technician to extract the fluid by hand and eliminates the need for separate receptacles.

Additionally the blister pack system may include channels on the sides. The channels provide holding space for a technician's utensils. The channels also allow a technician to scrape excess fluid off of a utensil or finger and trap the fluid in the channel. This reduces mess around the technician's manicure or pedicure station. It also keeps the utensils from being lost or contaminated, such as by being set on a countertop or rolling off of a countertop, before or during a procedure.

The cavities are revealed by peeling back and removing a sealing layer. Once the pack is opened, the technician can view the entire contents of the blister pack. Preferably, each of the fluids is different colored. The differently shaped tablet cavity helps the technician maintain proper orientation of the pack during the manicure or pedicure procedure. This helps individuals that are not able to read the language that may be printed on a package because it allows them to not only identify the products in the pack by color, it also ensures a progression. The technician knows to always work from the proximal tablet cavity across to the distal cavity using one successive product at a time. So even if the orientation of the pack is accidentally shifted, the pack can easily be reoriented and the correct product may be used.

DETAILED DESCRIPTION

Figure 1:
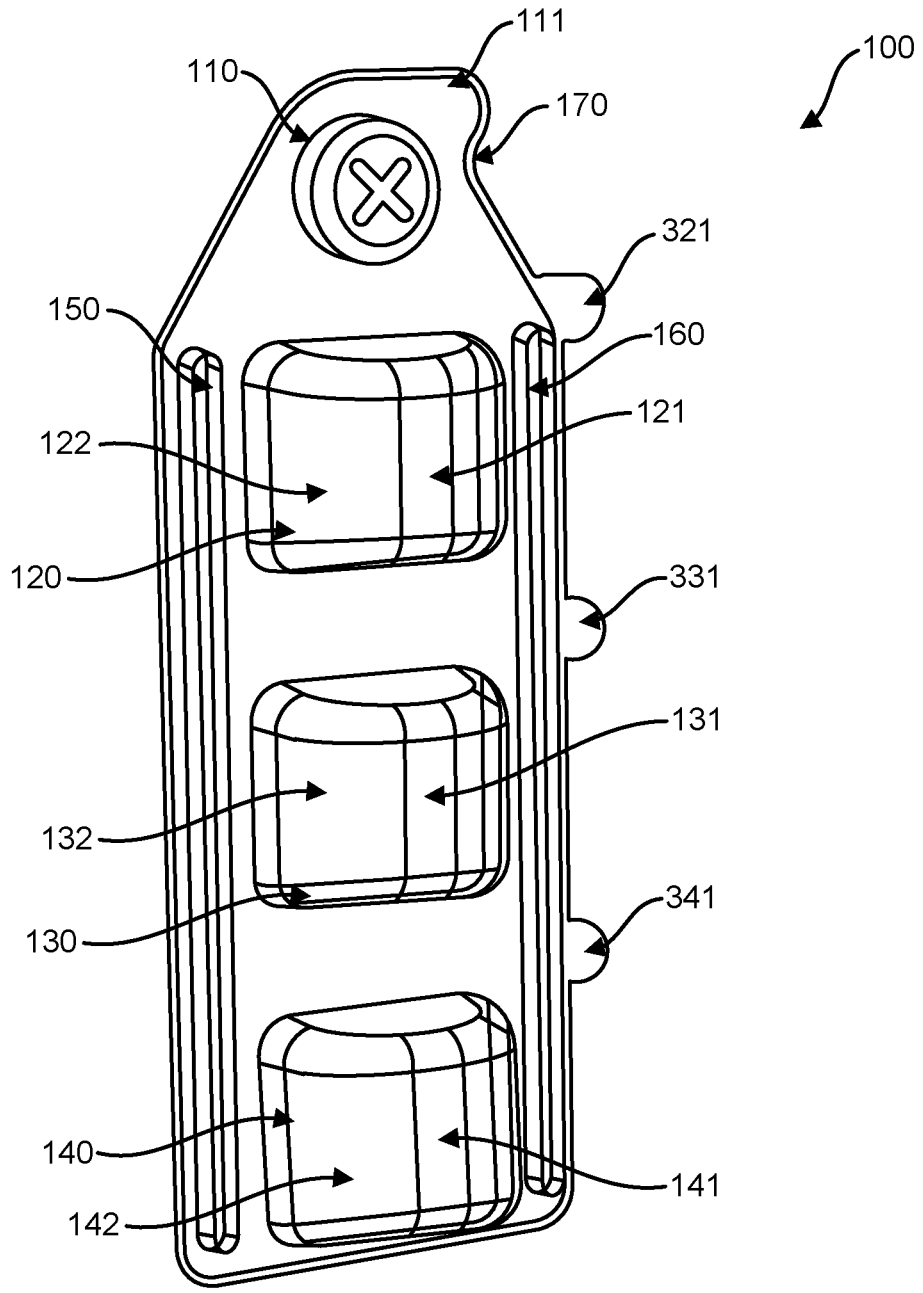
FIG. 1 is a perspective view of an embodiment of the present blister pack depicting the casing of the blister pack covered by the film.

Throughout the specification, wherever practicable, like structures will be identified by like reference numbers. In some figures, components may not be shown for clarity in the drawings. Unless expressly stated otherwise, the term "or" means "either or both" such that "A or B" includes A alone, B alone, and both A and B together.

FIG. 1 generally depicts an embodiment of the blister pack system 100. The blister pack system is generally separable into two parts, the casing 200 (FIG. 2) and the film 300 (FIG. 3). The film overlays and is affixed to the casing, for example by gluing or heat-sealing the film to the casing. In the preferred embodiment, the casing includes four cavities, 110, 120, 130, and 140, and two channels 150 and 160, though alternate embodiments could include more or less of the foregoing.

The film 300 is preferably a fluid impermeable layer. For example, the film may be a metal foil or plastic. Alternately the film could be a combination of metal foil, plastic, or paper.

FIG. 3 is a depiction of an embodiment of the film 300. In the embodiment shown, the film 300 is adapted to cover casing 200 which has four cavities. The film may be a single, uniform piece of film that may be conceptually divided into four sections 310, 320, 330, and 340 where film section 310 covers cavity 110, film section 320 covers cavity 120, film section 330 covers cavity 130, and film section 340 covers cavity 140. The film includes tab 311 extending from the main body of the film and preferably located at a proximal end of the film.

The film sections may alternately be semi-separated, such as by perforations, or completely separated and independent from one another. In the embodiments depicted in FIG. 3, perforation 350 separates section 310 from section 320, perforation 360 separates section 320 from section 330, and perforation 370 separates section 330 from section 340. Preferably, the perforations are formed only in locations that correspond to the flat portions of the casing. That is, the perforations are not formed on a section of the film that, when the film is applied to the casing, would be located above any of the cavities 110, 120, 130, or 140, or above either channel 150 or 160. That prevents the cavities and channels from being contaminated by material transitioning from the outside world through the perforations and into the cavities or channels.

Preferably, each section includes a tab. In the embodiment shown in FIG. 3, section 310 includes tab 311, section 320 includes tab 321, section 330 includes tab 331, and section 340 includes tab 341. As shown, the tab extends from the main body of each section. The tab provides a gripping portion to the film when the film is sealed to the casing. That is, when the film is sealed to the casing, the tab remains unsealed to the casing such that a technician may grasp the tab and pull the tab to peel the film section away from the casing and reveal a cavity. Preferably the tabs are aligned on one side of the main body of the film as shown in FIG. 3, however it is contemplated that they could be oriented on either side or both sides.

In the embodiment shown in FIG. 1, the tabs 321, 331, 341 all extend beyond the outer edge of the casing. That makes it easier for the technician to grasp the tab. However, in one embodiment, the casing also includes a flange 111 (see FIGS. 1 and 2) and the tab 311 does not extend beyond the flange. That structure helps protect the tab from damage. It should be understood that similar flanges could be used to protect other tabs, or no flanges at all could be used.

Utilizing flange 111, however, provides structural support at the proximal end of the casing and creates a nook 170 between the flange 111 and the angled side wall 270. The nook 170 enables a technician to manipulate the orientation of the casing with, for example, a long, thin tool and prevents the tool from simply sliding along the edge of the casing.

Figure 2:
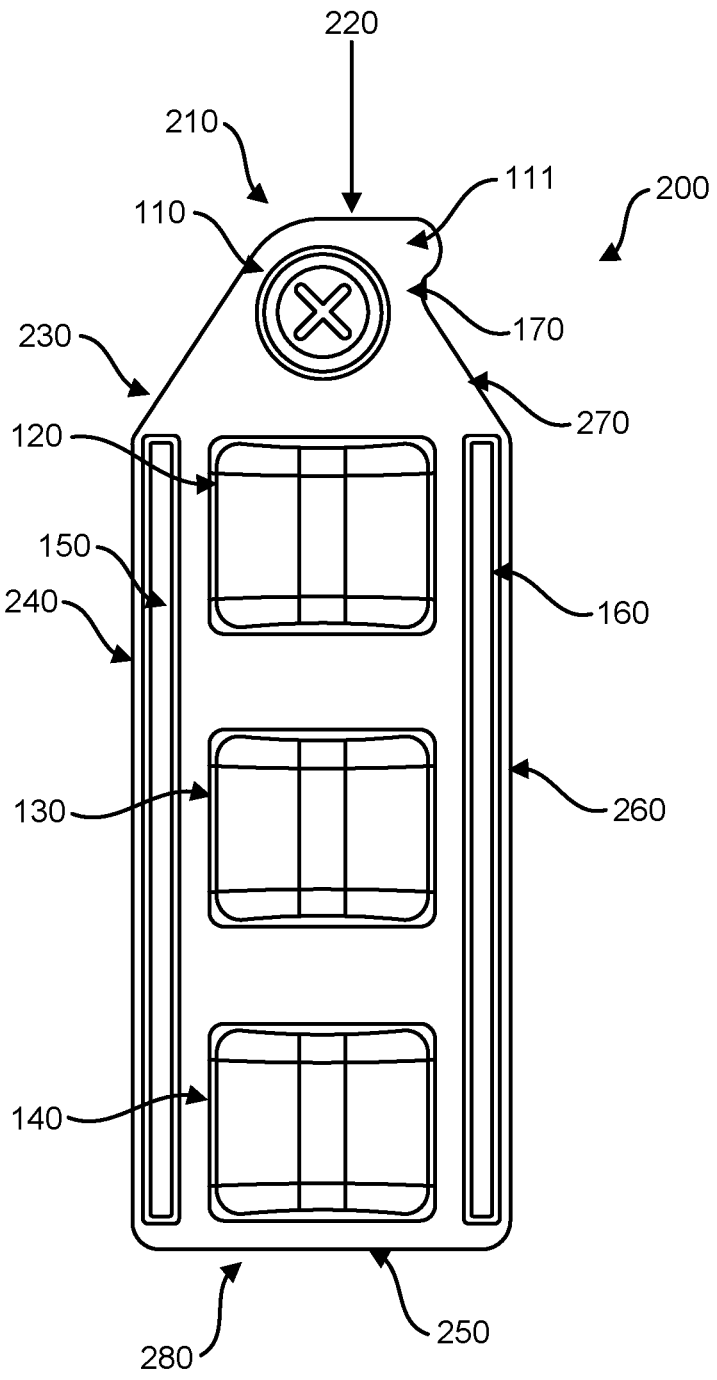
FIG. 2 is a plan view of an embodiment of the casing of the present blister pack from the top down.
Figure 3:
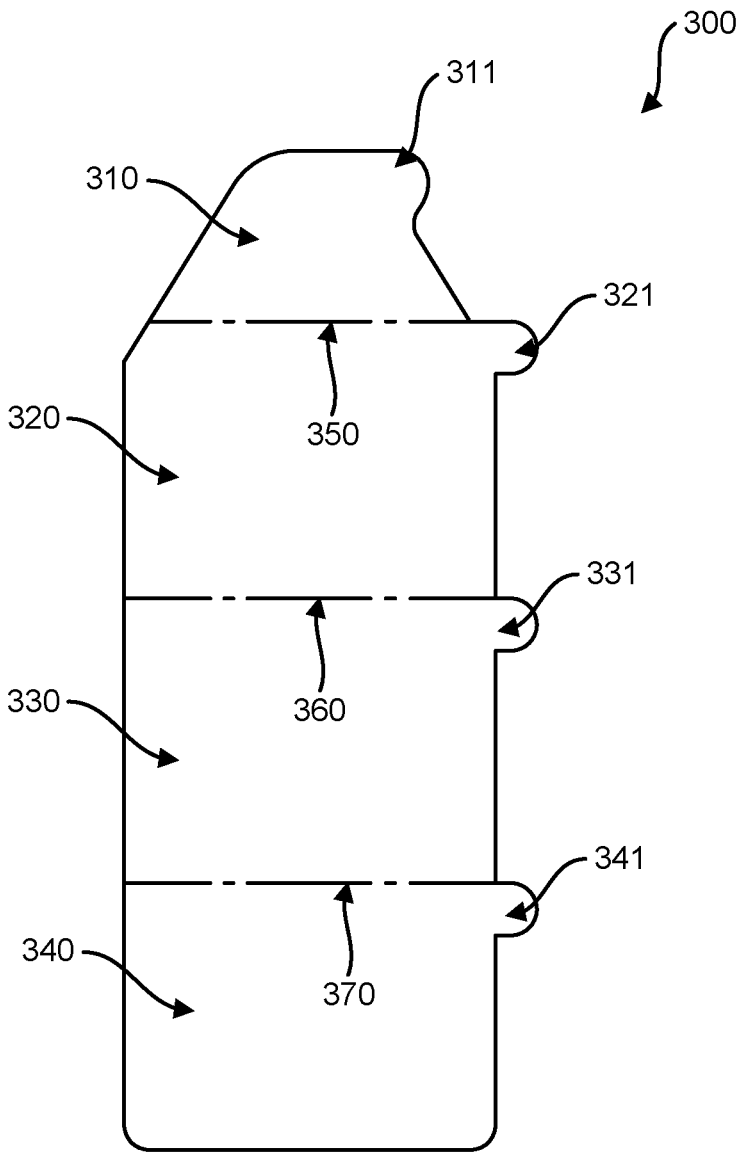
FIG. 3 is a plan view of an embodiment of the film of the present blister pack from the top down.
Figure 4:
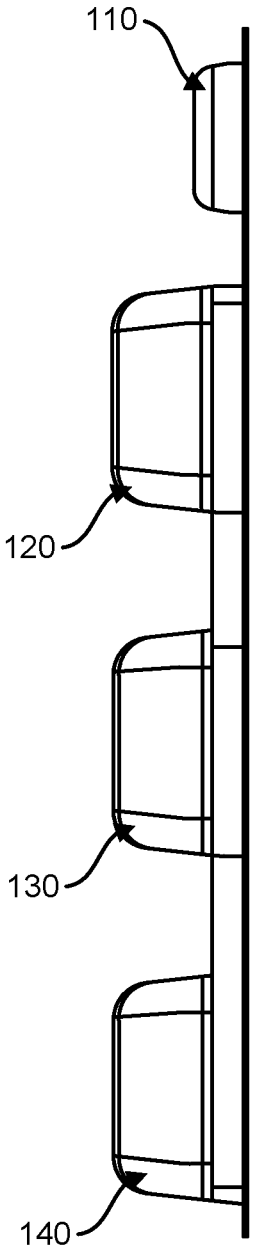
FIG. 4 is a depiction of an embodiment of the casing of the present blister pack from the side.

While the casing could be any shape, in one embodiment, as shown in FIG. 2, the casing may be substantially rectangular. The proximal end, 210, is tapered whereas the distal end 280 is substantially squared off. In the embodiment of FIG. 2, the casing includes proximal side 220, that is connected to and transitions to tapered side 230, that is connected to and transitions to length 240, that is connected to and transitions to distal side 250, that is connected to and transitions to length 260, that is connected to and transitions to tapered side 270 which includes flange 111, that is connected to and transitions to proximal side 220.

The tapered sides 230 and 270 provide visual cues to the technician as to which end is the proximal end and which end is the distal end when the casing is oriented such that the film is facing up and the cavities are setting on a surface. That in turn informs the technician which product is located in which cavity when different products are held in different cavities.

In one embodiment, cavities 110, 120, 130, and 140 each contain different products. For example, cavity 110 contains a tablet for creating a soaking solution, cavity 120 may contain a scrub compound, cavity 130 may contain a mask compound, and cavity 140 may contain a lotion. In one embodiment, each compound may provide a different scent, such as mint scent for the tablet, vanilla scent for the scrub, cucumber scent for the mask, and mango scent for the lotion. Each product may be contained in successive cavities such that the technician uses each in order, working from the proximal end to the distal end. Thus, the present blister pack can eliminate the need to read any information about the products, and even after the pack is opened, or if the pack gets disoriented during use, the technician may easily reorient the pack (such as by having the proximal end on the left and the distal end on the right) and progress through each product knowing that each product is being used in the correct order.

With respect to the cavities, the cavities may be of any shape. However, it is found that utilizing cavities of the shape shown has distinct advantages. For example, cavity 110 may be circular. Generally, cavity 110 is used to hold a small tablet that is used to create a solution. The circular shape of cavity 110 minimizes the amount of plastic needed to create the casing to house the tablet. It also allows for the formation of tapered sides 230 and 270. The other three cavities, 120, 130, and 140, generally contain fluid substances (such as scrubs, pastes, or lotions). The cavities are provided with flat bottoms 121, 131, 141 to maintain stability of the blister pack when it is set on a counter. Each cavity also has at least one curved side, 122, 132, 142, though it is contemplated that the cavities may be symmetrical. The curved sides 122, 132, 142, allow for ease of extraction of the contents of the cavities. For example, a technician can use a finger to scrape the fluid out of the cavity more easily when the cavity has a curved side than from cavities with substantially squared off sides. In one embodiment the cavities are approximately two inches across and may accommodate one or two human fingers.

As discussed above, the casing 200 may include at least one channel. As shown in FIGS. 1 and 2, channel 150 extends along the length 240. In the embodiment shown, channel 150 is a substantially "U" shaped recess, though other shapes of channels could be used. The film 300 covers the channel until the film is removed by the technician. Thus, the channel provides a clean location for the technician to store tools. Additionally, because technicians may extract fluid from the cavities with their fingers, the channel alternately provides a location for the technician to scrape excess fluid off of the fingers or tools. In the embodiment shown, there are two channels, 150 and 160. Thus, a technician may use one channel for storing a clean utensil, and use the other to store excess fluid.

It should be understood that the exemplary system described herein and shown in the drawings represents one particular embodiment of the blister pack system. Various modifications and additions may be made to such embodiments without departing from the spirit and scope of the invention. Accordingly, it is intended that the appended claims be interpreted as covering all alterations and modifications as fall within the spirit and scope of the invention.

What is claimed is:

1. A blister pack comprising:

A unitary, inseparable casing having an asymmetrical perimeter, a proximal end, and a distal end and a film affixed to the casing;

wherein said casing includes a proximal cavity, and a plurality of additional cavities, said additional cavities including a distal cavity and at least two central cavities, said proximal cavity being located at the proximal end of the casing, said distal cavity being located at the distal end of the casing and the at least two central cavities being located between the proximal cavity and the distal cavity such that the four cavities generally form a line;

wherein each cavity has a three-dimensional shape defining its volume;

wherein said proximal cavity has a different three-dimensional shape than the three-dimensional shape of the distal cavity;

wherein the film includes at least one tab that is not affixed to the casing; and wherein the film is affixed to the casing such that it covers each of the cavities and forms a seal around each of the cavities.

2. A blister pack as in claim 1 further comprising a first channel formed in the casing, separated from each of the proximal cavity and the plurality of additional cavities, and extending alongside a plurality of the additional cavities between the distal end and the proximal end of the casing.

3. A blister pack as in claim 2 further comprising a second channel formed in the casing, separated from each of the proximal cavity and the plurality of additional cavities and separated from the first channel, and extending alongside a plurality of the additional cavities between the distal end and the proximal end of the cavity; wherein the plurality of additional cavities are oriented between the first channel and the second channel.

4. A blister pack as in claim 2 wherein the film includes a plurality of lines of perforations such that at least one line of perforations is formed in the film between the proximal cavity and a central cavity and wherein a plurality of the lines of perforations are formed perpendicularly to the first channel.

5. A blister pack as in claim 4 wherein one or more of the plurality of the lines of the perforations separate the film into a plurality of sections, where one section is the portion of the film between two adjacent lines of perforations;

wherein each section includes at least one tab that is not affixed to the casing, and wherein the at least one tab extends from the perimeter of the casing.

6. A blister pack as in claim 1 wherein the proximal cavity includes a tablet and wherein at least one of the additional cavities includes a first fluid and at least one of the additional cavities includes a second fluid, and wherein the first fluid and second fluid are different.

7. A blister pack as in claim 1 wherein the proximal cavity includes a tablet and wherein each of the additional cavities includes a different fluid.

8. A blister pack as in claim 1 wherein the proximal cavity contains a tablet for creating a soaking solution, a first one of the central cavities arranged closer to the proximal cavity than to the distal cavity contains a scrub compound, a second one of the central cavities arranged closer to the distal cavity than to the proximal cavity contains a mask compound, and the distal cavity contains a lotion.

9. A blister pack as in claim 1 wherein at least one of the additional cavities is substantially U-shaped, with a flat bottom, two substantially vertical side-walls, and a curvature;

wherein the side-walls are oriented perpendicularly to a length of the casing, which length extends between the proximal end and the distal end, such that the curvature of the U-shape comprises a smooth curve extending from the flat bottom toward a foil contact surface of the casing such that the curvature curves up and toward the length of the casing.

10. A blister pack comprising:

a unitary, inseparable casing having an elongated approximately rectangular shape with a proximal end having a proximal width, a distal end having a distal width, and two sides between the proximal end and the distal end wherein said two sides are greater in length than both the proximal width and the distal width;

a film affixed to the casing;

wherein said casing includes a proximal cavity and a plurality of additional cavities, said additional cavities including a distal cavity and at least two central cavities, said proximal cavity being located at the proximal end of the casing, said distal cavity being located at the distal end of the casing and the at least two central cavities being located between the proximal cavity and the distal cavity such that the four cavities generally form a line;

wherein, in a portion of the proximal end where the proximal cavity is formed, the two sides each comprise an angled portion that angles toward the proximal cavity and extends alongside a portion of the proximal cavity, such that the proximal width is less than the distal width;

wherein each cavity has a three-dimensional shape defining its volume;

wherein said proximal cavity has a different three-dimensional shape than the three-dimensional shape of the distal cavity;

wherein the film includes at least one tab that is not affixed to the casing; and wherein the film is affixed to the casing such that it covers each of the cavities and forms a seal around each of the cavities.

11. A blister pack as in claim 10 further comprising a first channel formed in the casing, separated from each of the proximal cavity and the plurality of additional cavities, and extending alongside a plurality of the additional cavities between the distal end and the proximal end of the casing.

12. A blister pack as in claim 11 further comprising a second channel formed in the casing, separated from each of the proximal cavity and the plurality of additional cavities and separated from the first channel, and extending alongside a plurality of the additional cavities between the distal end and the proximal end of the cavity wherein the plurality of additional cavities are oriented between the first channel and the second channel.

13. A blister pack as in claim 10 wherein the film includes a plurality of lines of perforations such that at least one line of perforations is formed in the film between the proximal cavity and a central cavity and wherein the casing does not include any perforations corresponding to the at least one line of perforations formed in the film.

14. A blister pack as in claim 13 wherein one or more of the plurality of lines of the perforations separate the film into a plurality of sections;

wherein one section is the portion of the film between two adjacent lines of perforations, and wherein each section includes at least one tab that is not affixed to the casing.

15. A blister pack as in claim 11 wherein the first channel terminates before the sides of the casing begin to angle toward the proximal cavity.

16. A blister pack as in claim 10 wherein at least one side of the casing includes a nook formed at the proximal end along the angled portion such that said nook remains fixed in the casing even when any contents of any cavity is exposed.

17. A blister pack as in claim 10 wherein the proximal cavity includes a tablet and wherein at least one of the additional cavities includes a first fluid and at least one of the additional cavities includes a second fluid, and wherein the first fluid and second fluid are different.

18. A blister pack as in claim 10 wherein the proximal cavity includes a tablet and wherein each of the additional cavities includes a different fluid.

19. A blister pack as in claim 10 wherein the proximal cavity contains a tablet for creating a soaking solution, a first one of the central cavities arranged closer to the proximal cavity than to the distal cavity contains a scrub compound, a second one of the central cavities arranged closer to the distal cavity than to the proximal cavity contains a mask compound, and the distal cavity contains a lotion.

20. A blister pack as in claim 10 wherein each cavity further contains a product, and wherein each product in each cavity has a different scent than any of the other products in any of the other cavities.

* * * * *